US005820184A

United States Patent [19]

Echenay

[11] Patent Number: 5,820,184

[45] Date of Patent: Oct. 13, 1998

[54] LIFTING RUDDER

[75] Inventor: Alain Echenay, Collonges-Au-Mont-D'Or, France

[73] Assignee: Topal Industries, France

[21] Appl. No.: 734,589

[22] Filed: Oct. 22, 1996

[30] Foreign Application Priority Data

Apr. 16, 1996 [EP] European Pat. Off. ..... 96440029

[51] Int. Cl.[6] ..... B66C 1/10

[52] U.S. Cl. ..... 294/81.2; 294/81.3; 294/81.56

[58] Field of Search ..... 294/81.1, 81.2, 294/81.21, 81.3, 81.5, 81.55, 81.56, 81.6, 67.1, 67.2, 67.21, 67.4, 74

[56] References Cited

U.S. PATENT DOCUMENTS

| | | | |
|---|---|---|---|
| 3,343,861 | 9/1967 | Sinicki | 294/81.2 |
| 3,547,478 | 12/1970 | Pradon | 294/81.21 |
| 3,561,810 | 2/1971 | Newsted | 294/81.3 |
| 4,128,267 | 12/1978 | Niblett et al. | 294/81.56 |
| 4,626,012 | 12/1986 | Weldele | 294/81.3 |
| 4,973,795 | 11/1990 | Sharpe | 294/81.56 |

FOREIGN PATENT DOCUMENTS

| | | | |
|---|---|---|---|
| 2541258 | of 0000 | France . | |
| 29505191 | of 0000 | Germany . | |
| 1159560 | 7/1969 | United Kingdom | 294/81.3 |
| 2016404 | 9/1979 | United Kingdom | 294/81.2 |

*Primary Examiner*—Dean Kramer
*Attorney, Agent, or Firm*—Young & Basile, P.C.

[57] ABSTRACT

A lifting rudder device consists of a standard I-beam (1), a hanging element (2) and two suspension elements (3). The suspension elements (3) are slid onto the lower flank (12) of the beam (1), and each consists of two parallel plates (30) formed of a central hollow in the form of a 'T' into which passes the lower flank (12) and the core (10) of the beam (1). The plates (30) are solidified by two pendulums (37), each pierced by a hole (38) into which a pin passes levelly crossing the core (10) of the beam by one of the holes (16) along its length. The lower edge (39) of each of these pendulums (37) rests on the internal face (15) of the lower flank (12). The lower edge (39) includes a central curved part concentric to the hole (38) of the pendulum (37) and two flat ends, tangent to the central curved part.

18 Claims, 4 Drawing Sheets

LIFTING RUDDER

BACKGROUND OF THE INVENTION

The present invention is a lifting rudder device.

A lifting rudder is designed to be placed between the prehension system of a lifting engine and the load in order to multiply the points of hanging to raise the load. A lifting rudder consists of, for this purpose, one or several beams and hanging and suspension elements.

There are actually several types of lifting rudders, who are differentiated principally by their suspension elements, the structure of which depends on the structure of the beam.

The most widespread type of lifting rudders are the adjustable rudders, of which the suspension elements, also called cursors, are moveable lengthwise on the beam or on a part of the beam to permit the adaptation of their distance to the dimensions of the load in order to achieve a vertical slinging.

Most known cursors are either in the form of a ring slid onto the beam, or in the form of a 'T' introduced between the two parts of a double beam, or in the form of a 'C' slid on the lower flank of an I-shaped beam.

The positioning of a cursor at a determined site is achieved by means of a rack united to the beam, which can be achieved by the welding of wedges.

With particular adaptations, the adjustable rudders may allow a slinging on the bias. However, when the cursors are sloped, the effects are badly distributed, which can lead to the escape of at least one of the cursors.

For the same reasons, the beam of the majority of existing rudders must stay in a mostly horizontal position and, yet, it is frequent that the load to be lifted is badly balanced, which leads to the incline of the beam. It is therefore necessary to restore the balance by moving the cursors.

On the other hand, for all the existing rudders, the hanging means consists of a ring soldered onto the beam which turns out to be inconvenient, in case of the deterioration of the ring, which makes the rudder unusable during the time of reparation, which cannot be achieved quickly.

The goal of the present invention is to remedy these diverse inconveniences by proposing a lifting rudder with mobile cursors, which enables, all while being a simple conception, a slinging on the bias and an inclination of the beam, and which is more easily transportable.

SUMMARY OF THE INVENTION

A lifting rudder device according to the present invention is characterized in one part of a standard I-beam comprised of two parallel positioned flanks and a core, and in another part, a hanging element and two suspension elements secured to the beam. The suspension means is slid onto the inferior flank of the beam, and consists of two parallel fastened plates, solidified one to the other by welding and each containing a hollow in the form of a 'T' which permits the passage of the inferior flank and the core of the beam. The solidification between the plates is achieved by the two intermediate pendulums each pierced by a hole into which is introduced a pin, or similar means, levelly crossing the core of the beam in one of the holes that it includes along its length, the interior edge of each of the pendulums coming into contact with the internal face of the flank on which are slid the plates, the interior edge consisting of a central curved part concentric to the hole of the pendulum and of two flat ends tangent to the central curved part.

According to an additional characteristic of the device according to the present invention, the hanging element is slid onto the upper flank of the beam and consists for this purpose of two parallel plates each including a central hollow in the approximate form of a 'T' for the passage of the upper flank and the core of the beam, the plates being solidified one to the other in the middle by a ring and by fasteners which are each pierced by a hole meant to receive a pin, or similar element levelly crossing the core of the beam by a hole made in its middle.

According to a variance of the device according to the present invention, the hanging element consists of two groupings slid onto the upper flank of the beam and permitting hanging by two slings. Each of the groupings consists of two parallel plates each including a central hollow in the form of a 'T,' solidified one to the other from a lower part by means of two fasteners each pierced by a hole permitting the passage of a pin, or similar element, levelly crossing the core of the beam, and from an upper part by means of a crossing plate including an hanging eye moved laterally towards the middle of the beam.

A rudder device according to the invention permits a vertical slinging or slinging on the bias, and allows an inclination of the beam. In addition, the replacement of the hanging element can be achieved rapidly without the necessity of unsoldering and soldering. In addition, the fabrication of a rudder device according to the invention only necessitates the realization of the elements of suspension and hanging, which are assembled on the site of their destination, to a standard I-beam whose only necessary adaptation is the piercing of several holes.

BRIEF DESCRIPTION OF THE DRAWINGS

The advantages and the characteristics of the present invention will stand out more clearly in the description which follows and which relates to the attached drawing, which depicts several non-limiting ways of realization.

In the attached drawing.

DESCRIPTION OF THE PREFERRED EMBODIMENTS

Figure 1:
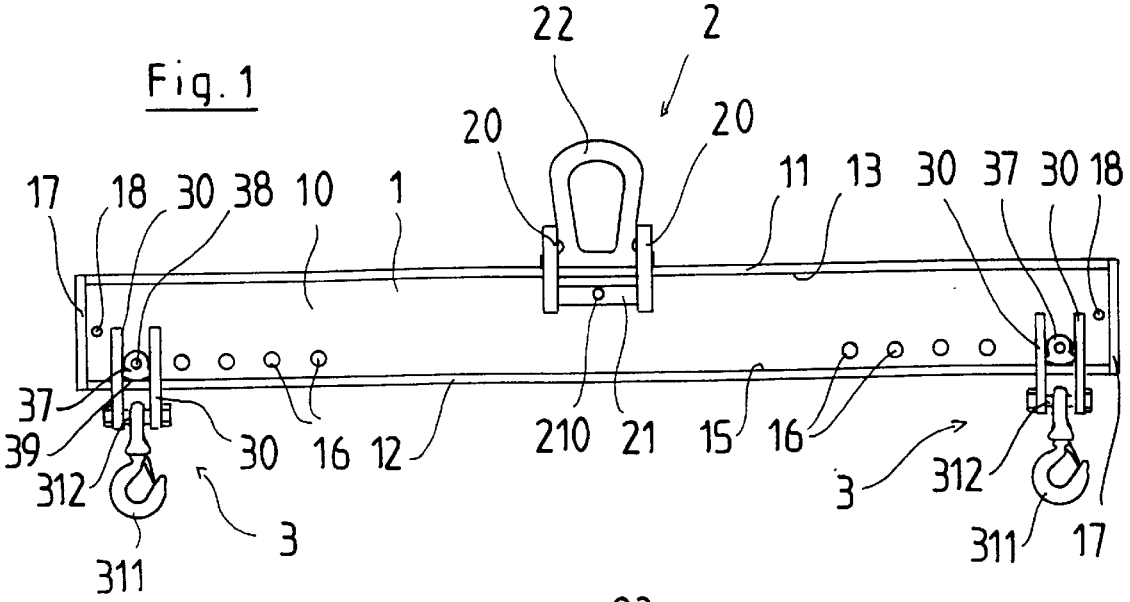
FIG. 1 depicts a face of a device according to the invention.
Figure 2:
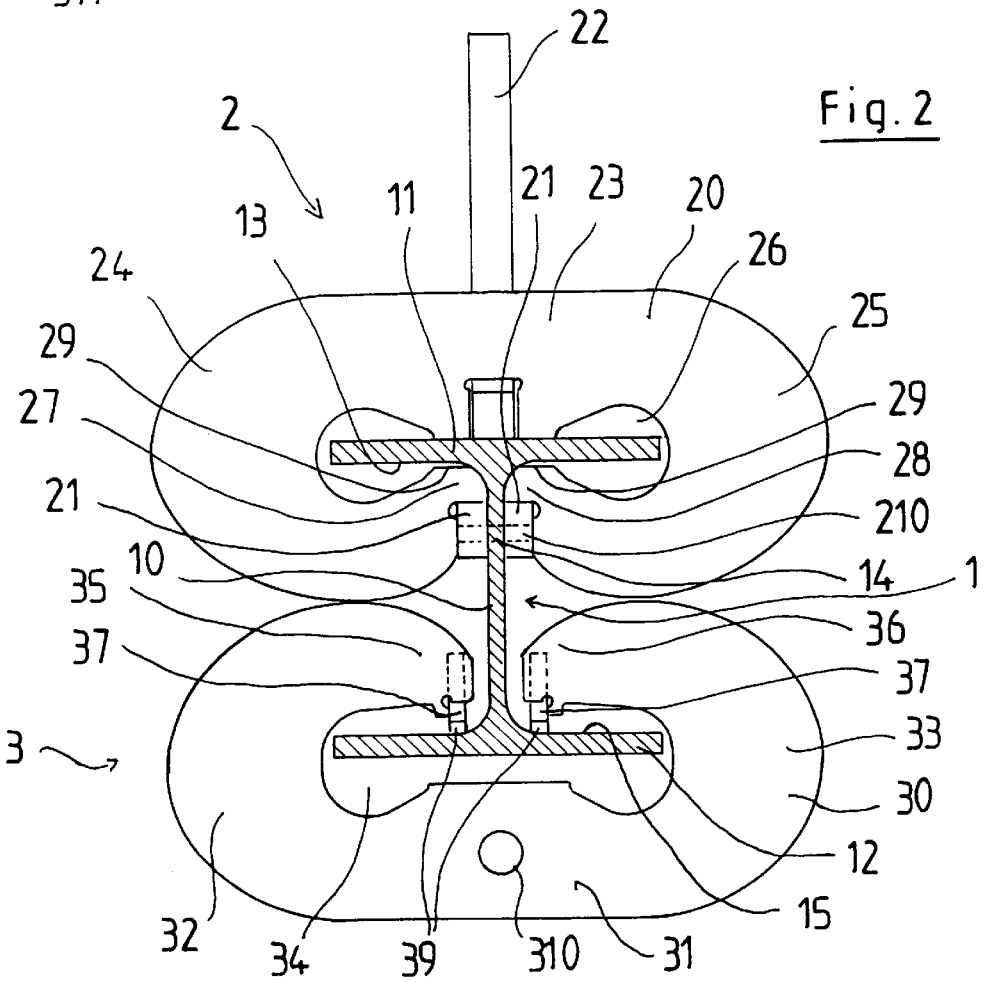
FIG. 2 depicts a side view of the same device.

If one refers to FIGS. 1 and 2, one can see that a lifting rudder device according to the invention includes as one part a standard I-beam 1 consisting of a core 10 and parallel upper and lower flanks 11 and 12, respectively, and another part including two suspension elements 3. A hanging element 2 includes two parallel plates 20 solidified at a certain distance from one to another by welding, by means of two fasteners 21, and by a hanging ring 22.

Each of the plates 20 is cut in the form of a 'C,' that is to say, each plate 20 includes a linear extended body 23 as one part and also two curved parts 24 and 25, which form a central hollow 26 and of which the ends 27 and 28 are opposite each other at a short distance from one to the other.

The ends 27 of the two plates 20 are solidified together by a fastener 21 and the ends 28 are solidified by another fastener 21, while the hanging ring 22 is joined to the bodies 23.

The hanging element 2 is slid onto the beam 1 by making the upper flank 11 slide into the hollow 26, the core 10 passing between the ends 27 and 28 and the fastener 21, and the internal face 13 of the flank 11 resting on internal edges 29 of the ends 27 and 28.

The positioning of the hanging element 2 in the middle of the beam 1 is secured by a pin, or similar element, not represented, crossing the fastener 21 by holes 210, of which only one is visible in FIG. 1, as well as the core 10 of the beam 1 by a hole 14 visible in FIG. 2.

It is notable that the cutting of the plates 20 is such that there remains, between the body 23 and the ends 27 and 28, only the space necessary for the passage of the flank 11 in order to avoid a pivoting movement around the pin.

Each of the suspension elements 3 includes two parallel plates 30 also cut in the form of a 'C,' that is to say, each comprising a prolonged body 31 and two curved parts 32 and 33 who form a central hollow 34 of which the ends 35 and 36, respectively, are opposite each other and at a certain distance from one to the other.

Figure 3:
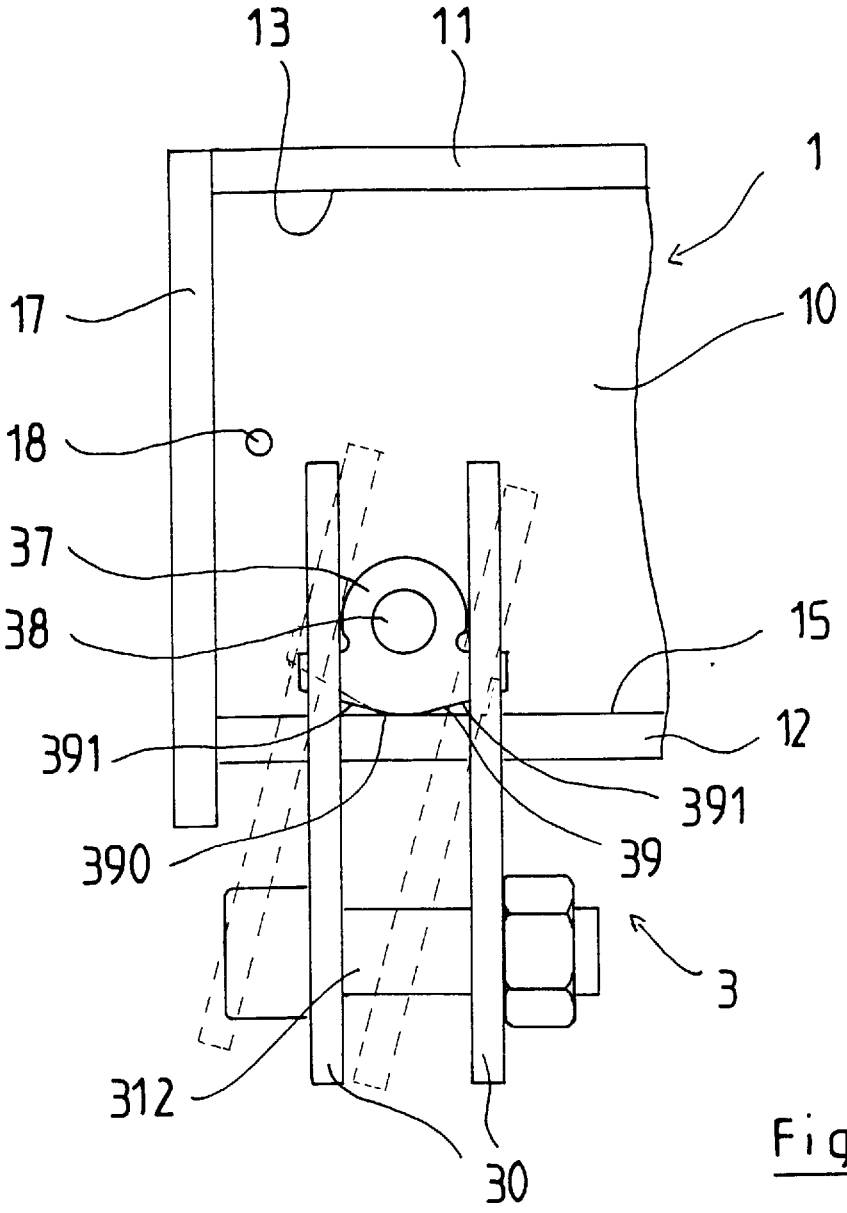
FIG. 3 depicts a detailed view of the same device.

As one can see more precisely in FIG. 3, the plates 30 are solidified at a certain distance from one to the other by two pendulums 37, each joining the ends 35, the other ends 36 of the plates 30, and by making the pendulums 37 project into the hollow 34.

Each of the suspension elements 3 is joined to the beam 1 by introducing the lower flank 12 of the beam 1 in the hollow 34 of the plates 30, the core 10 passing between the ends 35 and 36, and with the pendulums 37 resting on the internal face 15 of the flank 12.

The positioning of the suspension element 3 on the beam 1 is achieved by means of a pin or similar element, not represented, crossing the pendulums 37 by a hole 38, and passing through one of the holes 16 formed in the end parts of the core 10.

The lower edges 39 of the pendulums 37 each contain a central curved part 390, concentric to the hole 38, and two flat ends 391 tangent to the central part 390.

The pendulums 37 and the remaining space between the body 31 of the plates 30 and the flank 12 allow a pivoting of the suspension elements 3 on the flank 12 around the pin, with pivoting limited by the ends 391 of the lower edges 39 of the pendulums 37.

The body 31 of each of the plates 30 includes a hole 310 roughly centered in each body 31 permitting the fixation of a hook 311 between the plates 30 as shown in FIG. 1, by means of a pin, or similar element 312.

The device according to the invention is completed, for aesthetic reasons and security reasons, by two upright plates 17, fixed to the ends of the beam 1 by means of fasteners, not represented, which are slid in the holes 18 pierced in the core 10 of the beam 1.

The assembly of the rudder device according to the invention only necessitates the operations of piercing the holes 14 and 16 and the holes 18, and of fixation of the upright plates 17.

Figure 4A:
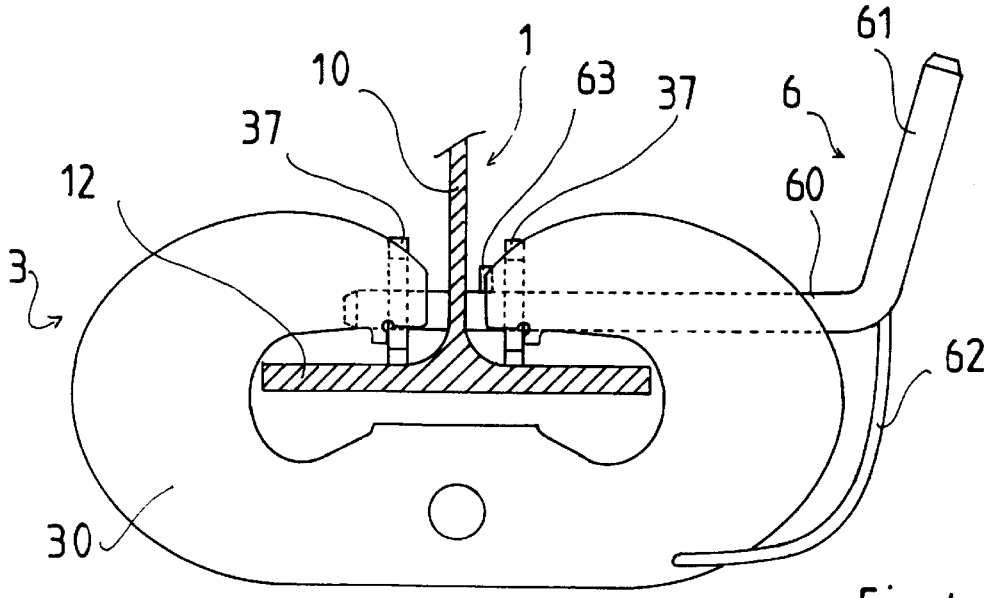
FIGS. 4*a* and 4*b* depict partial views of the side face of a particular way of production.
Figure 4B:
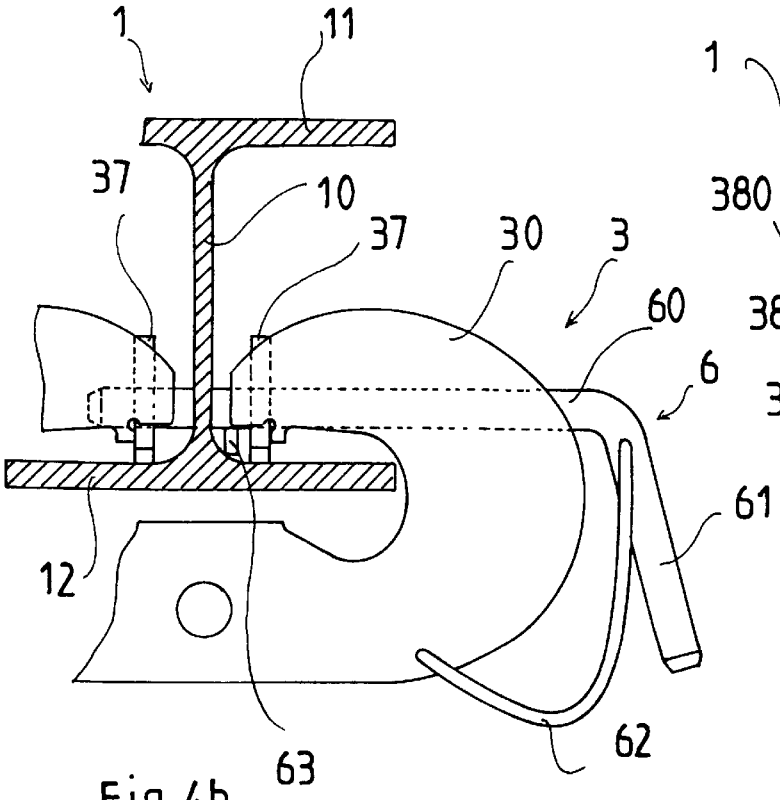
Figure 4C:
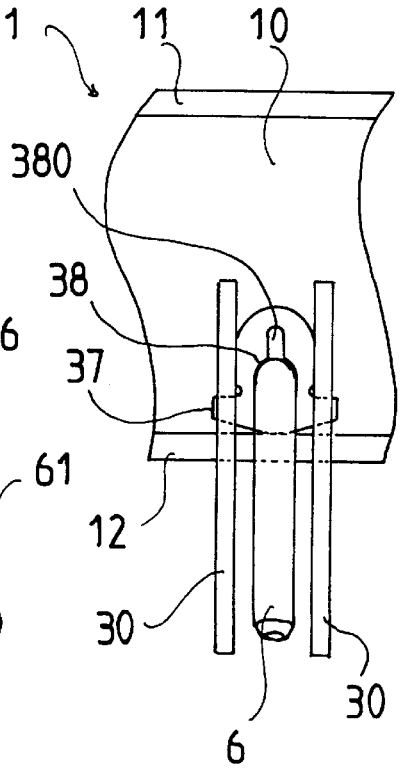
FIG. 4*c* depicts a partial view of the side face that is represented in FIG. 4*b*.

If one now refers to FIGS. 4*a*, 4*b* and 4*c*, one can see that the maintenance of position of a suspension element 3 on the beam 1 is achieved by means of a spindle 6 introduced in the holes 38 of the pendulums 37 and crossing the core 10 of the beam 1 by one of the holes 16, not visible.

The spindle 6 is bent which divides it in two parts, one part 60 to be inserted in the holes 38 and 16, and a handle 61. A cable 62 for example, not represented in FIG. 4*c*, is joined in a loose manner to one of the plates 30 of the suspension elements 3.

The part 60 includes at a certain distance from its insertion end, and at least equal to the space separating the two pendulums 37, a lug 63 projecting perpendicularly from the same side from which the handle 61 is bent, while the hole 38 of the pendulum 37 in which the spindle 6 is first introduced is prolonged towards the top 25 by a slit 380, visible in FIG. 4*c*, permitting the passage of the lug 63.

This ensures, as is depicted in FIG. 4*a*, that the passage of the spindle 6 is only possible when the handle 61 is turned towards the top, in order to permit the passage of the lug 63 in the slit 380.

When the lug 380 is passed through the pendulum 37, and the end of the spindle 6 is introduced in the hole 16 and in the hole 38 of the other pendulum 37, the handle 61 is lowered and the lug 380 inserts itself between the core 10 and the pendulum 37, as is shown in FIG. 4*b*. The spindle 6 is therefore blocked.

Figure 5:
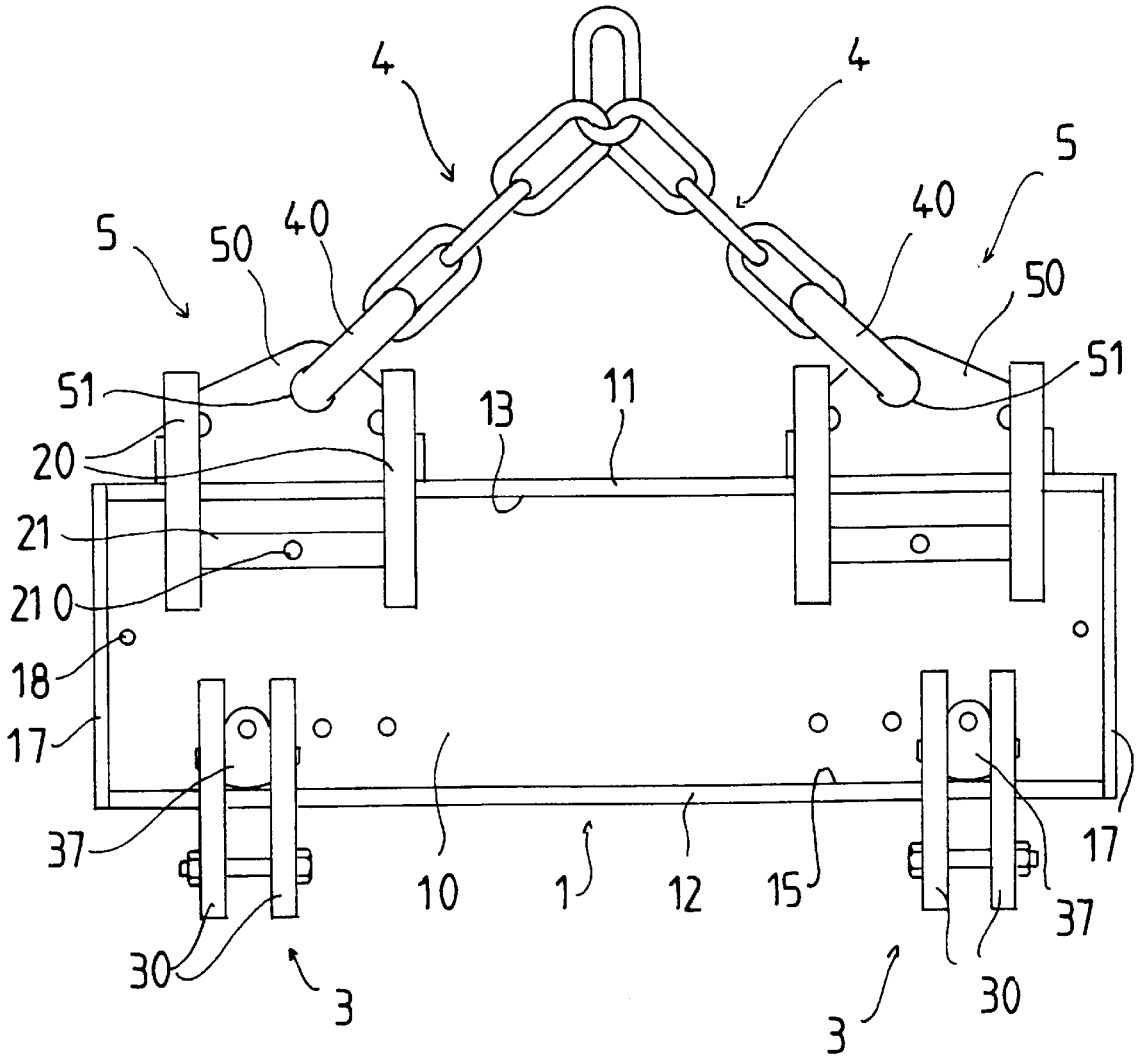
FIG. 5 depicts a face of a variant of the device according to the invention.

If one refers now to FIG. 5 one can see that in the case of a hanging by means of two slings 4, the device according to the invention is comprised of two hanging groupings 5 and two suspension elements 3.

Each of the hanging groupings 5 differ from the hanging element 2 described above in that the ring 22 is replaced by a plate 50 pierced in an upper region of an eye 51 for the solidification of a sling 4 by means of a shackle 40, the eye 51 being off center towards the middle of the beam 1 in order to permit a better distribution of the load. The suspension elements 3 are identical to those described above and as shown in FIGS. 1 and 2.

What is claimed is:

1. A lifting rudder device for use with a standard I-beam formed of two parallel upper and lower flanks positioned on either side of a core, and a hanging element and two suspension elements secured to the beam, the lifting rudder device comprising:

the suspension elements slid onto the lower flank of the beam and each consisting of two parallel fastened plates fixedly joined one to the other and each including a central hollow in the form of a 'T' which allows the passage of the lower flank and the core of the beam, two intermediate pendulums each pierced by a hole into which a pin passes levelly crossing the core of the beam by one of a plurality of holes in the beam, the lower edge of each of the pendulums contacting the internal face of the lower flank, the lower edge including a central curved part concentric to the hole of the pendulum and two flat ends tangent to the central curved part.

2. The device according to claim 1 characterized by the hanging element slid onto the upper flank of the beam, the hanging element formed of two parallel plates each including a central hollow in the approximate form of a 'T' for the passage of the upper flank and the core of the beam, the plates joined one to the other by the middle of a ring and fasteners which are each pierced by a hole for the passage of a pin levelly crossing the core of the beam in a hole in the middle of the core.

3. The device according to claim 2 characterized by the plates of the suspension elements and the hanging elements being in the form of a 'C' including a prolonged body and two curved parts creating the central hollow of which the ends are opposite each other and spaced at a short distance from one to the other.

4. The device according to claim 1 characterized by the hanging element formed of two groupings slid into the upper flank of the beam allowing the hanging of two slings, each of the groupings consisting of two parallel plates each including a central hollow in the form of a 'T' joined one to the other from a lower part by two fasteners each pierced by a hole allowing the passage of a pin levelly crossing the core of the beam and from another upper part by a cross plate including a hanging eye laterally shifted towards the middle of the beam.

5. The device according to claim 1 characterized by two upright plates which are each joined to one end of the beam by a flange slid into holes in the core of the beam.

6. The device according to claim 1 characterized by the maintenance of a position of one suspension element on the beam by a spindle passed into the holes of the pendulums and in one of the holes in the core of the beam, the spindle including at a distance from its insertion end at least equal to that which separates the pendulums a lug projecting perpendicularly, the hole of the pendulum in which the spindle is introduced is prolonged towards a top by a slit allowing the passage of the lug therethrough.

7. The device according to claim 6 characterized by the spindle joined in a loose manner to one of the plates of the suspension element.

8. A lifting rudder device for use with a standard I-beam formed of two parallel upper and lower flanks positioned on either side of a core, and a hanging element and two suspension elements secured to the beam, the lifting rudder device comprising:

the suspension elements slid onto the lower flank of the beam and each formed of two parallel fastened plates fixedly joined one to the other and each including a central hollow in the form of a 'T' which allows the passage of the lower flank and the core of the beam therethrough;

two intermediate pendulums each having a lower edge;

means for pivotally mounting the two pendulums on the beam; and the lower edge of each of the pendulums contacting an internal face of the lower flank of the beam.

9. The device according to claim 8 wherein the pendulum mounting means comprises:

a hole formed in each pendulum;

a plurality of spaced holes formed in the core of the beam; and a pivot member extending through one of the holes in the core of the beam and the hole in the two pendulums.

10. The device according to claim 9 wherein:

the pivot member extends transversely to the core of the beam.

11. The device according to claim 9 further comprising:

the lower edge of each pendulum including a central curved part concentric to the pivot member and two oppositely extending flat ends tangent to the central curved part.

12. The device according to claim 9 further characterized by one spindle extending into the holes of the pendulums and in one of the holes in the core of the beam to maintain a fixed position of one suspension element on the beam, the spindle including, at a distance from its insertion end at least equal to a distance separating the two pendulums, a lug projecting perpendicularly, the hole of the pendulum in which the spindle is introduced being prolonged towards a top end to allow the passage of the lug therethrough.

13. The device according to claim 12 further characterized by the spindle joined in a loose manner to one of the plates of one suspension element.

14. The device according to claim 8 characterized by:

the hanging element slid onto the upper flank of the beam, the hanging element formed of two parallel plates each including a central hollow in the approximate form of a 'T' for the passage of the upper flank and the core of the beam therethrough; and pivotal mounting means for mounting the two plates to the core of the beam.

15. The device according to claim 14 wherein the pivotal mounting means comprises:

the plates joined one to the other by a ring and fasteners which are each pierced by a hole for the passage of a pivot pin extending through a hole in the core of the beam.

16. The device according to claim 14 characterized by the plates of the suspension elements and the hanging element being in the form of a 'C' including a prolonged body and two curved parts creating the central hollow of which the ends are opposite each other and spaced at a short distance from one to the other.

17. The device according to claim 8 characterized by the hanging element formed of two groupings slid into the upper flank of the beam allowing the hanging of two slings, each of the groupings comprising:

two parallel plates, each including a central hollow in the form of a 'T' joined one to the other from a lower part by two fasteners each pierced by a hole receiving a pivot pin extending through the core of the beam and from another upper part by a cross plate including a hanging eye laterally shifted towards a middle of the beam.

18. The device according to claim 8 further characterized by two upright plates each joined to one end of the beam by a flange mounted on the core of the beam.

* * * * *